United States Patent [19]

Kolaian et al.

[11] 4,056,355

[45] Nov. 1, 1977

[54] DETERGENT FORMULATIONS AND THEIR USE

[75] Inventors: Jack H. Kolaian, Wappingers Falls; Frederic C. McCoy, Beacon; John A. Patterson, Fishkill, all of N.Y.

[73] Assignee: Texaco Inc., New York, N.Y.

[21] Appl. No.: 535,758

[22] Filed: Dec. 23, 1974

[51] Int. Cl.[2] ..... C11D 3/08

[52] U.S. Cl. ..... 8/137; 252/89 R; 252/540; 252/559

[58] Field of Search ..... 8/137; 252/89, 540, 252/559

[56] References Cited

U.S. PATENT DOCUMENTS

| | | | |
|---|---|---|---|
| 2,531,166 | 11/1950 | Shaw | 252/540 |
| 2,956,025 | 10/1960 | Lew | 252/161 |
| 2,956,026 | 10/1960 | Lew | 252/161 |
| 3,010,849 | 11/1961 | Lense | 8/137 |
| 3,129,187 | 4/1964 | Meehan | 252/559 |
| 3,676,338 | 7/1972 | Fries | 252/8.75 |
| 3,679,608 | 7/1972 | Aubert | 252/526 |
| 3,704,228 | 11/1972 | Eckert | 252/117 |

FOREIGN PATENT DOCUMENTS 244,835 1/1963 Australia.

*Primary Examiner*—Paul R. Michl

*Attorney, Agent, or Firm*—Thomas H. Whaley; Carl G. Ries; Bernard Marlowe

[57] ABSTRACT

This invention concerns the use of certain biogradable detergents containing as their sole active surfactant component linear, paraffinic alcohols containing 6 to 18 carbon atoms. These fatty alcohols have good laundering activity particularly to launder soiled cotton. These alcohols can be formulated in an aqueous solution containing only builders or optionally they can be formulated as multicomponent solid detergents in the form of a homogeneous, free-flowing powder. Using standard laundering tests these materials function well as detergents at low concentration levels, exhibit comparable or superior surfactant activity to sulfonated alkylated benzenes in the removal of soil from cotton or other cellulosics.

4 Claims, No Drawings

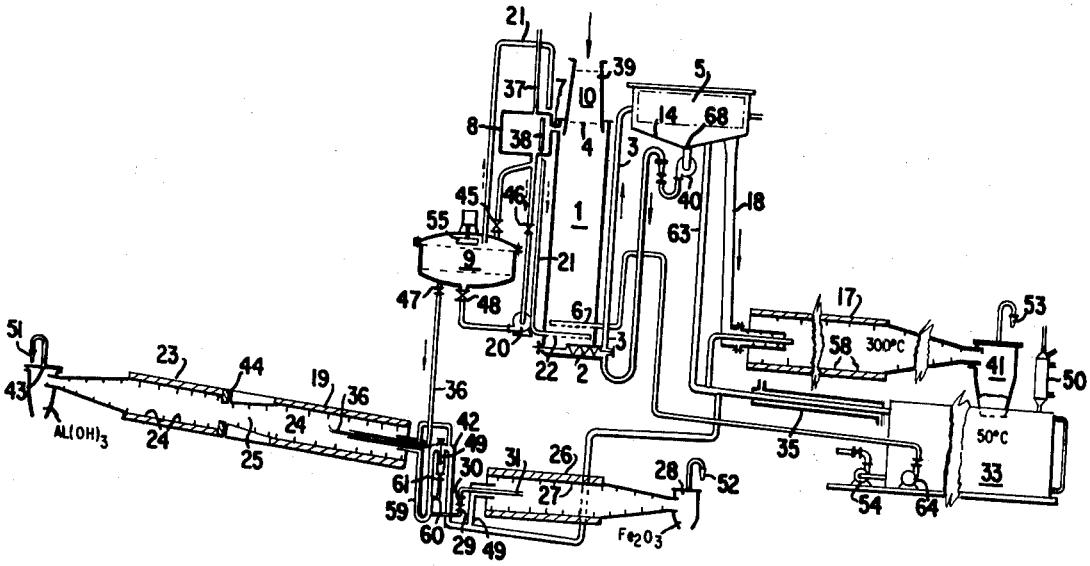

DETERGENT FORMULATIONS AND THEIR USE

BROAD DESCRIPTION OF THE INVENTION

This invention concerns the use of linear paraffinic (fatty) alcohols as the sole surfactant in detergent compositions for the laundering of soiled cellulosics and the detergent compositions formulated therein.

More particularly, this invention relates to linear fatty, primary or secondary alcohols containing 6 to 18 carbon atoms which can be utilized to launder cotton in the form of simple aqueous solutions or in the form of dry, free flowing powdered detergents.

BACKGROUND OF THE INVENTION

There is no paucity of surfactants for use in detergent compositions per se. However, even the most widely used detergents for home laundry use, linear alkyl-benzene sulfonates (LABS) or alcohol ethoxylates (AEO) have shortcomings. For example, the ethoxylated alcohols are relatively costly compared to their precursor alcohols and, while effective against soiled synthetics, are comparatively poor for the laundering of cellulosics such as cotton. Good activity against cellulosics such as cotton is still important even with the increasing use of synthetics because cellulosics are the most widely used fabric in garment manufacture. In addition, the cellulosics can be readily dyed, they are durable and, since they "breathe", they are comfortable to wear. The LABS formulations are relatively poor in removing soil in cellulosics and are only slowly biodegradable in the soil. Until this invention, there was a need for a low cost, readily available, surfactant with good laundering activity against cotton and other cellulosics, possessing low mammalian toxicity and which is readily biodegraded by microorganisms in the soil.

Recently the applicants have discovered that not only are certain alkanols active as surfactants, but that certain aspects of this surfactant activity are both unexpected and unobvious because:

1. The linear or branched fatty alcohols (also known as paraffinic alcohols or alkanols) are relatively insoluble in the water environment in which they are used;
2. It has been found that there is a substantial dropping off of their surfactant activity in the fatty alcohols containing less than 7 carbon atoms and those above 16 carbon atoms;
3. The surfactant activity of these alkanols is quite specific for cotton fabrics as opposed to synthetic fabrics such as nylon, dacron etc.;
4. When these active alkanols are optionally formulated with finely divided, chemically non-reactive inorganic powders passing through a 325 mesh screen having a surface area of at least 30 $M^2/g$ in addition to conventional builders, the flowability of the formulations is greatly improved and detergency in standard laundering tests is improved.

SUMMARY OF THE INVENTION

In its broadest contemplated formulation embodiments, this invention relates to three component or higher liquid, containing detergent compositions as their sole surfactant entity, fatty alcohols having 6 to 18 carbon atoms, accompanied by alkaline builders and optional detergent adjuvants or additives.

In its narrowest contemplated formulation and preferred form, at least a surfactant amount of one or more alkanols containing from 9 to 14 carbon atoms is blended with a water-insoluble, chemically non-reactive, finely divided inorganic powder, as well as alkanine builder, optional fillers and detergent adjuvants to produce a free-flowing detergent composition, which is utilized in an aqueous environment to remove soil from cotton.

To further aid in the understanding of said inventive embodiments, the following disclosure is submitted.

A. Surfactant—As defined throughout this application, a surfactant is the detergent component which exerts or contributes the primary cleaning power or cleansing effect upon the soiled substrate to be treated. In this invention the surfactant is limited to only fatty alcohols or, synonomously, paraffinic alcohols or alkanols which by definition are saturated alcohols. These can contain primary or secondary hydroxyl groups and contain 6 to 18 carbon atoms, preferably these alcohols contain 9 to 14 carbon atoms. These alcohols can be in the form of single, discrete alcohols such as n-decanol, n-undecanol, n-dodecanol, tridecanol, etc. or they can be in the form of mixtures of primary alcohols and/or secondary alcohols. These mixtures may be described, for example, as $C_{10}$–$C_{14}$ primary alcohols or $C_{10}$–$C_{14}$ secondary alcohols.

B. Concentration—Inasmuch as the above-described fatty alcohols are the primary source of cleansing (surfactant) power in the inventive detergent formulation, to function properly the aqueous cleaning bath containing the soiled substrate must contain at least a minimal amount of the alcohol(s) to be effective. It has been determined experimentally that these surfactants must be present in quantities of at least 0.1% by weight of the cleaning bath to be effective as a surfactant. The upper limit does not appear to be critical to success of the detergent but quantities in excess of 1% by weight of the bath appears to be wasteful.

C. Cellulosic Substrate—As used throughout this disclosure, the substrates are natural cellulose or its modified derivatives. These include the preferred cellulosic substrates, cotton, as well as linen, hemp, jute flax, cuprammonium rayon, viscose rayon and the like. The substrates can be used in the form of their yarns, fibers or threads, or in their manufactured form such as woven cloths, knitted fabrics, webs or any other fabricated form utilizing textile fabricating processes.

D. Finely Divided Water—Insoluble Chemically Non-Reactive Inorganic Powders. These are the absorbent materials which are employed to prepare detergents in the form of free-flowing powders, which have by far the largest share of the home detergent market. The physical prerequisites of these inorganic powders are the ability to pass in their entirety through a 325 mesh sieve and having a surface area of at least 30 $M^2/g$, preferably 100-300 $M^2/g$.

While most of the above catagorized inorganic chemically inert, water-insoluble, finely divided powders are operable, the preferred powders are silicas, Ca silicates and alumina having the physical characteristics listed above. Amont the suitable products are those marketed under the trade names Hi-Sil, Cab-O-Sil, Microcel, Aerisul and Alon C. They are preferred because they appear to potentiate the surfactant activity of the alkanols. Other microcrystalline materials which are suitable are aluminates, clays, including kaolin, the bentonites and the montmorillonites and the like, all of which must have the physical properties referred to previously.

E. Builders—These are alkaline materials, preferably inorganic salts, such as the alkali metal salts. For the sake of simplicity, these will be illustrated by the sodium salts although the other corresponding alkali metal salts can usually be substituted for sodium. Illustrative of such salts as $Na_2CO_3$, $NaHCO_3$, $Na_2HCO_3.Na_2CO_3$ (sodium sesquicarbonate) $Na_2B_4O_7.10H_{20}$ (Borax in the usual commercial form) $Na_4SiO_4$ (sodium orthosilicate), $Na_2SiO_3$ (sodium metasilicate) and sodium citrate, etc. In addition, for certain special detergent applications, neutral soluble salts such as sodium sulfate or sodium chloride can be employed with the fatty alcohol surfactants of this invention.

F. Optional Detergent Adjuvants or Detergent Additives—Often, it is desirable to modify, alter or change one or more characteristics or a given detergent of this invention. The additives employed are generically referred to as "adjuvants". Ordinarily, they constitute from 1 to 10% by weight of the dry detergent composition, preferably between about 1 to 5% of the detergent composition. Among others, the following classes of adjuvants may be employed: anti-redeposition-compounds such as sodium carboxymethyl cellulose, starch derivatives, methyl cellulose, polyvinyl alcohol, polyvinylpyrrolidone, etc. heavy metal sequestering agents including ethylenediaminetetraacetic acid and its salts, citric acid salts and gluconic acid. Also present are optional optical bleach or brightening agents, corrosion inhibitors, tarnish inhibitors, germicides and the like.

G. Formulation of Inventive Detergent Compositions—No specific mode or order of addition of detergent components is required to formulate the multi-component detergents of this invention. Ordinarily, free flowing, finely divided homogeneous, granular detergents are made by intimately grinding the alcohol with the inorganic powders of Section D and the builder and any other detergent additives or adjuvants employed are then added and blended in. In controls, using only alcohol and builder (such as $Na_2CO_3$), the alcohol, builder and any other optional additives are ground in a mortar to produce a homogeneous mixture.

H. Initial Screening Procedure using Launder-Ometer Test Procedures Expressed as Average Reflectance—Multiple test samples of 4 cotton cloths, 2¼ inches in diameter in size, 3 soiled and one unsoiled cloth, are charged to Launder-Ometer cannister containing appropriate amounts of sodium nitrilo-triacetate (NTA) builder, experimental surfactant, hard water (standard hard water made up to a total hardness of 3000 p.p.m. with $Ca^{++}$ and $Mg^{++}$) and sufficient distilled water to produce a final concentration of surfactant is 0.1 percent and 0.2 percent in each of two cannisters. The final builder/detergent is initially 70/30. The total hardness of the solution is about 300 p.p.m.

After the cannisters are sealed, the Launder-Ometer is run for 10 minutes at a predetermined temperature, 60° C. At the end of this time, the test swatches are then removed from the cannisters, rinsed twice with distilled water and dried.

The effectiveness of the test—Detergent solution is obtained by determining the amount of soil removed from the soiled test cloth samples using a reflectometer. Average Reflectance value is read directly from the instrument.

2. Using the identical test procedure described previously in the screening tests, Reflectance values of unsoiled (Ruu), washed soiled (Rsw) and soiled unwashed cloth (Rsu) are used to calculate percent detergency as follows:

$$\text{Per Cent Detergency} = \frac{Rsw - Rsu}{Ruu - Rsw}(100)$$

Using this approach, maximum detergency (100%) corresponds to a reflectance value equal to that of the unsoiled cloth. Since the detergent effectiveness can be related to the effectiveness of the comparison standard, this approach calculates the percent detergency similar to that used above and relates this value to the percent detergency of the standard, thus giving a detergency coefficient as shown below:

$$\text{Detergency Coefficient} \quad \frac{\text{Per Cent Detergency Exp. Surfactant}}{\text{Per Cent Detergency Std. Surfactant}}(100)$$

3. Detergent coefficient values less than 90 indicate an experimental material to be less effective than the standard, while values above 110 indicate greater effectiveness than the standard.

Unless otherwise specified, all parts or percentages are by volume and all temperature measurements are in degrees centigrade rather than Fahrenheit.

EXAMPLES 1–7

Evaluation of $C_6$ to $C_{21}$ Alkanols' Activities as Detergents

Using the screening procedure described on page 9 of this application, five fatty alcohols ranging from $C_8$ to $C_{14}$ containing NTA are formulated at concentration levels of 0.1–0.2% by weight using 0.2–0.4% by weight of the named builder. Table I gives the results obtained as Average Reflectance. For comparison, the same concentrations of commercial detergents referred to as linear alkyl benzene sulfonate (LABS) and alpha-olefin sulfonate are evaluated under the same conditions as the fatty alcohols.

As the data indicate, fatty alcohols containing 8 to 14 carbon atoms, alone or in mixtures primary or secondary are essentially equal to or superior as detergents than the two commercially used detergents.

EXAMPLES 8–14

Using the screening procedure described above, 1-decanol and $C_{10-14}$ secondary alcohols were tested alone and with NTA builder, in comparison with a commercial alpha-olefin sulfonate. In both cases the alcohols gave superior results. (See Table II).

EXAMPLES 15–26

The examples shown in Table III illustrate the effectiveness of $C_6$ to $C_{18}$ alcohols with $Na_2CO_3$ builder, in comparison with a commercially marketed household detergent. They also illustrate the drop in effectiveness below $C_8$ and above $C_{16}$ alcohol chain length. When Example 18 is compared with Example 25, the apparent *p* tentiating effect of Micro-Cel is indicated.

EXAMPLES 27–29

Table IV illustrates the use of micro-fine powders other than Micro-Cel. When Examples 27–29 are compared with Examples 18 and 25 in Table III, it is evident that fumed silica and fumed alumina have an even greater potentiating effect on detergency than Micro-Cel.

TABLE I

| Example | Compound(s) Evaluated + NTA Builder | Average Reflectance |
|---|---|---|
| 1 | 1-Octanol | 33.6 |
| 2 | 1-Decanol | 49.9 |
| 3 | 2-Decanol | 45.0 |
| 4 | 2-Dodecanol | 46.0 |
| 5 | $C_{10}$-$C_{14}$ secondary alcohol mixture | 42.0 |
| 6 | LABS | 39.9 |
| 7 | α-olefin sulfonate | 36.1 |

TABLE II

DETERGENCY TESTS - ALCOHOLS + BUILDER

| Example | Formulation | Detergency Coefficient |
|---|---|---|
| 8 | Commercial Alpha-olefin-sulfonate (bioterge) | 67 |
| 9 | Nitrilo-triacetic acid, Na salt (NTA-commercial builder) | 48 |
| 10 | Bioterge (3 parts) + NTA (7 parts) | 102 |
| 11 | 1-Decanol | 48 |
| 12 | 1-Decanol (3 parts) + NTA (7 parts) | 195 |
| 13 | $C_{10}$-$C_{14}$ secondary alcohol mixture | 51 |
| 14 | $C_{10}$-$C_{14}$ secondary alcohol mixture (3 parts) + NTA (7 parts) | 133 |

A particularly surprising finding that is advantageous is that the formulation of these alcohols, surfactants with insoluble, finely particulated inorganic adsorbents to make free-flowing solid forms of the alcohol surfactants potentiates the surfactant activity of the alcohols, especially when siliceous microcrystalline powders are used as the solid absorbent. Insofar as is known, this synergistic activity imparted to the $C_6$ to $C_{18}$ alcohols has not appeared in the literature.

While several modifications, changes and substitutions can be made in the inventive concept without departing from the invention, the true measure of the metes and bounds of this invention can best be gleaned by perusal of the specification previously disclosed taken in conjunction with the claims that follow.

What is claimed is:

1. A process for removing the soil from soiled cotton fabric in an aqueous environment consisting essentially of:

A. contacting the soiled cotton fabric to be cleaned with a free-flowing detergent formulation of:

a. from about 5 to 45 parts by weight of at least one fatty alcohol surfactant containing 6 to 18 carbon atoms, said alcohol or alcohols being the sole surfactant present, b. from about 5 to 95 parts by weight of builder,

TABLE III

DETERGENCY TESTS - ALCOHOLS + BUILDER + MICROCEL

| Ex. | Formulation | Detergency Coefficient |
|---|---|---|
| 15 | Commercially Marketed Household Detergent[a] | 100 |
| 16 | Hexanol (1 Part) + $Na_2CO_3$ (7 Parts) + Microcel T-13 (1 Part) | 86 |
| 17 | Heptanol (1 Part) + $Na_2CO_3$ (7 Parts + Microcel T-13 (1 Part) | 115 |
| 18 | 1-Decanol (1 Part) + $Na_2CO_3$ (7 Parts + Microcel T-13 (1 part) | 202 ; 185 |
| 19 | Isodecanol (1 Part) +Na2$CO_3$ (7 Parts) + Microcel T-13 (Microcrystalline) [A Silicate] Approx. 100 SqM/g Surface Area) | 210 |
| 20 | Neodecanol " " | 187 |
| 21 | Tridecanol " " | 154 |
| 22 | 1-Octadecanol " " | 87 |
| 23 | $C_{10-14}$ Secondary Alcohol Mixture (1 Part) + $Na_2CO_3$ (7 Parts) + Microcel T-13 (1 Part) | 136 |
| 24 | Neodol 45[b] " " " | 115 |
| 25 | 1-Decanol " "(No Microcel) | 165 |
| 26 | $Na_2CO_3$(1 Part) + Microcel T-13 (1 Part) | 59 |

[a]7 parts $Na_2CO_3$, 1 part water, 1 part Na Metasilicate, 1 part ethoxylated alcohol.
[b]$C_{14-17}$ primary alcohols
[c]Defined on page 7.
NOTE:
In all of the experimental formulations containing MICROCEL, the alcohol and Microcel were intimately mixed and the $Na_2CO_3$ was then added and mixed to give free-flowing powders. In Formulation 9 containing no Microcel, the alcohol and $Na_2CO_3$ were ground in a mortar to give a pasty mass which retained its tendency to cake on storage.

TABLE IV

OTHER MICRO-FINE POWDERS

| Ex. | Formulation | Detergency Coefficient |
|---|---|---|
| 27 | Decanol (1 Part) + $Na_2CO_3$(7 Parts) + Aerosil (Fumed Silica) (0.7 Part) (100-300 $M^2/g$ | 268; 261 |
| 28 | Decanol (1 Part) + $Na_2CO_3$(7 Parts) + Alon C (Fumed Alumina) (0.7 Part) (100-300 $M^2/g$) | 259 |
| 29 | Decanol (1 Part) + $Na_2CO_3$(7 Parts) + Aerosil (0.3 Part) | 235 |

As the preceding description and examples have shown, the use of higher fatty alcohols as the sole surfactant in detergent compositions is both advantageous and gives unexpectedly good results compared to the widely used fatty alcohol derivatives such as the alkoxylates, the sulfonates etc., particularly in the removal of soil from cotton fabric. Further, where most ordinarily surfactants are soluble in water, these higher carbon content alcohols are insoluble in water. In addition, these higher fatty alcohols are readily biodegradable, which is an important advantage in maintaining a safe ecological balance in our underground water supply.

c. from about 1 to 10 parts by weight of detergent additives, and d. from about 5 to 45 parts by weight of finely divided, water-insoluble, chemically non-reactive, inorganic absorbent passing through a 325 mesh sieve and having surface area of at least 30 $M^2/g$, said parts by weight of the free-flowing detergent formulation of (a), (b), (c) and (d) being based upon the final weight of the aqueous laundering environment;

B. continuing said contact of the soiled cotton with the aqueous laundering environment until substantially all of the soil has been removed from the soiled cotton.

2. The process of claim 1 wherein the builder is sodium carbonate.

3. The process of claim 1 wherein the inorganic absorbent is a silica, alumina or Ca silicate having a surface area between about 30–300 $M^2/g$.

4. A process for removing the soil from soiled cotton fabric in an aqueous laundering environment consisting essentially of contacting the soiled cotton to be cleaned in said aqueous environment with a biodegradable detergent having as its active components:

a. from about 5 to 45 parts by weight of at least one fatty alcohol surfactant containing 6 to 18 carbon atoms, b. from about 5 to 95 parts by weight of builder, selected from the group consisting of $Na_2CO_3$, $NaHCO_3$, $Na_2HCO_3.Na_2CO_3$, $Na_2B_4O_7$, $Na_4SiO_4$, $Na_2SiO_3$, $N(CH_2COONa)_3$ and $Na_3C_6H_5)_7$, c. from about 1 to 10 parts by weight of detergent additives, and d. from about 5 to 45 parts by weight of finely divided, water-insoluble, chemically non-reactive, inorganic absorbent passing through a 325 mesh sieve and having surface area of at least 30 $M^2/g$, said parts by weight of the free-flowing detergent formulation of (a), (b), (c) and (d) being based upon the final weight of the aqueous laundering environment, continuing said contact of the soiled cotton with the aqueous laundering environment until substantially all of the soil has been removed from soiled cotton.

* * * * *